US005871339A

United States Patent [19]

Goto et al.

[11] Patent Number: 5,871,339

[45] Date of Patent: Feb. 16, 1999

[54] VENTILATION ARRANGEMENT FOR A CASING COVERING A COMPRESSOR DRIVE UNIT

[75] Inventors: Naomi Goto, Shiga-ken; Norio Yoshida, Moriyama; Katsunori Makino, Otsu, all of Japan

[73] Assignee: Matsushita Electric Industrial Co., Ltd., Osaka-fu, Japan

[21] Appl. No.: 541,973

[22] Filed: Oct. 10, 1995

[51] Int. Cl.[6] ..... F04B 39/16

[52] U.S. Cl. ..... 417/313; 55/505

[58] Field of Search ..... 417/902, 313; 55/503, 505, 385.4; 310/88, 89, 53

[56] References Cited

U.S. PATENT DOCUMENTS

| | | | |
|---|---|---|---|
| 265,490 | 11/1882 | Higashikura | 417/902 |
| 2,251,964 | 8/1941 | Stackhouse | 55/503 |
| 2,410,522 | 11/1946 | Powell | 55/505 |
| 3,537,543 | 11/1970 | Gibel | 55/505 |
| 4,104,551 | 8/1978 | Blank et al. | 310/88 |
| 4,939,397 | 7/1990 | Morrill | 310/88 |
| 5,185,544 | 2/1993 | Takada | 310/88 |
| 5,507,618 | 4/1996 | Kubo et al. | 415/182.1 |
| 6,307,370 | 11/1994 | Kiyoshi | 417/902 |

FOREIGN PATENT DOCUMENTS

| | | | |
|---|---|---|---|
| 2151010 | 4/1973 | Germany | 310/88 |
| 0071252 | 5/1982 | Japan | 310/88 |

OTHER PUBLICATIONS

Grainger General Catalog No. 380, p. 93, 1991.

*Primary Examiner*—Timothy Thorpe
*Assistant Examiner*—Peter G. Korytnyk
*Attorney, Agent, or Firm*—Wenderoth, Lind & Ponack, L.L.P.

[57] ABSTRACT

A drive unit for driving an electrically-operated compressor mounted in an automotive vehicle is provided with a ventilation arrangement. The ventilation arrangement includes a casing having a vent hole defined therein. A filter having an air permeability and a water repellency is mounted on the casing so as to cover the vent hole. An elongated ventilation member is mounted on the casing so as to communicate with the vent hole and extends in a direction diverting from the direction in which the casing is splashed with water. The filter may be accommodated in the elongated ventilation member.

3 Claims, 7 Drawing Sheets

VENTILATION ARRANGEMENT FOR A CASING COVERING A COMPRESSOR DRIVE UNIT

BACKGROUND OF THE INVENTION

1. Field of the Invention

The present invention relates generally to a hermetically sealed waterproof casing for covering a drive unit which is supplied with electric power from a battery or a generator to drive an electrically-operated compressor mounted in an automotive vehicle and, more particularly, to a ventilation arrangement for such a casing.

2. Description of Related Art

An apparatus of a waterproof structure is generally provided with a hermetically sealed casing. However, in applications where the casing accommodates a heating element such as, for example, an electric component or the like, heat generated from the heating element causes expansion of air inside the casing, which in turn causes leakage of the air from between incompletely sealed portions of the casing. If operation of the heating element is consequently stopped, the air inside the casing contracts and, hence, air outside the casing is conversely sucked thereinto through the incompletely sealed portions. It is hardly possible to hermetically seal such incompletely sealed portions, because they include power lead wires made up of a core wire and a covering material. If water is drawn in together with the air, an electric circuit occasionally breaks down.

FIG. 11 depicts a casing 1 for covering a bath control unit installed in a wet bath room. This casing 1 has a vent hole 1*a* defined therein and a filter 2 mounted thereon so as to cover the vent hole 1*a*. To prevent water from entering the bath control unit, the filter 2 has a selective permeability to allow air to pass therethrough but repel water.

Accordingly, entry and exit of the air, which would be caused by thermal expansion and contraction of the air, are carried out through the filter 2 and not through the incompletely sealed portions, thus preventing entry of water.

A drive unit for driving an electrically-operated compressor for use in an automotive vehicle is required to be of a waterproof structure. It is therefore conceivable to form a vent hole in a casing of the drive unit and to cover the vent hole with an air-permeable and water-repellent filter as employed in the bath control unit.

However, unlike the inside of a house, automotive vehicles are exposed to a harsh environment, and attention must be paid to filter protection against water, salt, dust, oil, gases, mechanical stresses (impingement of an object against the filter) and the like.

SUMMARY OF THE INVENTION

The present invention has been developed to overcome the above-described disadvantages.

It is accordingly an objective of the present invention to provide a ventilation arrangement for an otherwise hermetically sealed casing which is water proof and covers a drive unit for driving an electrically-operated compressor mounted in an automotive vehicle, said ventilation arrangement being capable of preventing entry of water which may be caused by thermal expansion and contraction of air.

Another objective of the present invention is to provide the ventilation arrangement of the above-described type capable of protecting a filter mounted therein and facilitating filter maintenance.

A further objective of the present invention is to provide the ventilation arrangement of the above-described type which enables the drive unit to be mounted on a desired portion of a variety of automotive vehicles.

In accomplishing the above and other objectives, the ventilation arrangement according to the present invention comprises a casing having a vent hole defined therein, a filter mounted on the casing so as to cover the vent hole and having an air permeability and a water repellency, and an elongated ventilation member mounted on the casing so as to communicate with the vent hole. The elongated ventilation member extends in a direction diverting from a direction in which the casing is splashed with water, thereby protecting the filter against water, salt, dust, oil, gases, mechanical stresses, and the like. This ventilation arrangement is capable of preventing entry of water which may be caused by thermal expansion and contraction of air.

Conveniently, the elongated ventilation member is threaded into a nut with the casing interposed between the elongated ventilation member and the nut, thus facilitating filter maintenance and replacement. Filter replacement can be readily carried out merely by rotating either the elongated ventilation member or the nut. Furthermore, because the elongated ventilation member can be mounted on the casing by forming only a vent hole therein, it is possible to make ventilation members each including a filter have an identical configuration for various casings.

Advantageously, a readily bendable hose duct is mounted on the elongated ventilation member. Alternatively, a hose duct having a closed end and an open end may be rotatably mounted on the elongated ventilation member. In this case, the hose duct also has a vent hole defined therein which can be oriented in different directions by rotating the hose duct relative to the elongated ventilation member. With this arrangement, even if the direction in which the elongated ventilation member extends is fixed, it is possible to orient a free end of the hose duct to a desired direction diverting from the direction in which the casing may be splashed with water or may receive dust or the like. Accordingly, a compressor drive unit having this ventilation arrangement can be mounted on a desired portion of any kind of automotive vehicle.

Again alternatively, the elongated ventilation member may be bent at a location intermediate thereof. Even if the casing is splashed with water, the bent portion of the elongated ventilation member prevents the water from reaching the filter.

Advantageously, the elongated ventilation member partially has a varying inner diameter which gradually increases towards the casing. By so doing, even if a drop of water enters the elongated ventilation member, its surface tension reaches a limit as it passes through the portion of the increasing inner diameter. As a result, the drop of water flows out from the elongated ventilation member as small drops of water. Even if the small drops of water are left within the elongated ventilation member, they no longer advance deep thereinto. Accordingly, entry of water into the casing is positively prevented.

A porous member may be secured to a free end of the elongated ventilation member. Even if a portion of the porous member is splashed with water, air is allowed to pass through the remaining portion of the porous member and, hence, water is not introduced into the casing through the elongated ventilation member.

Although in the above-described ventilation arrangements the filter is mounted on the casing, it may be accommodated in the elongated ventilation member. This filter is hereinafter referred to as a first filter.

In this case, it is preferred that the elongated ventilation member comprises a first ventilation portion and a second ventilation portion into which the first ventilation portion is threaded with the first filter accommodated in threaded portions of the first and second ventilation portions.

Advantageously, a second filter is accommodated in the threaded portions of the first and second ventilation portions so as to be spaced from the first filter. In this case, the first filter is positioned farther than the second filter with respect to the casing and has a higher permeability than the second filter. Accordingly, dust having relatively large particles is caught by the first filter, while dust having relatively small particles is caught by the second filter. The use of the two filters is resistant to clogging, compared with the use of only one filter, thus facilitating filter maintenance.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
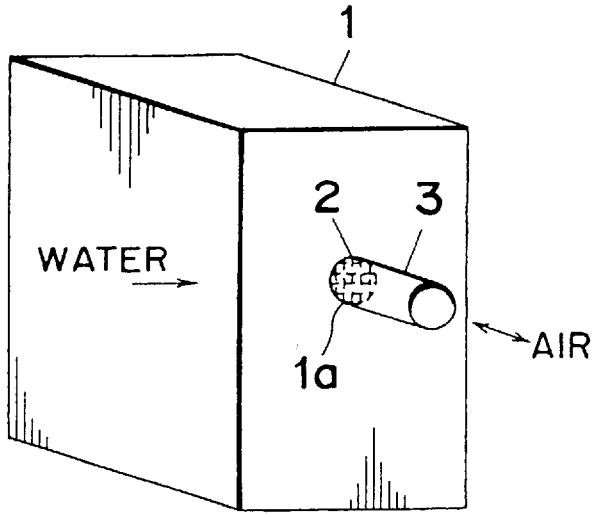
FIG. 1 is a perspective view of a ventilation arrangement according to a first embodiment of the present invention.

Referring now to the drawings, there is shown in FIG. 1 a hermetically sealed waterproof casing 1 intended to cover a drive unit for driving an electrically-operated compressor.

The casing 1 shown in FIG. 1 has a ventilation arrangement according to a first embodiment of the present invention. The ventilation arrangement includes a vent hole 1*a* defined in the casing 1 and a filter 2 mounted on the casing 1 so as to cover the vent hole 1*a*. The vent hole 1*a* is communicated with a generally cylindrical ventilation duct 3 extending outwardly from the casing 1 in a direction diverting from the direction in which the casing 1 may be splashed with water, thereby protecting the filter 2 against water. The ventilation duct 3 also protects the filter 2 against mechanical stresses such as, for example, impingement of an object thereagainst.

Figure 2:
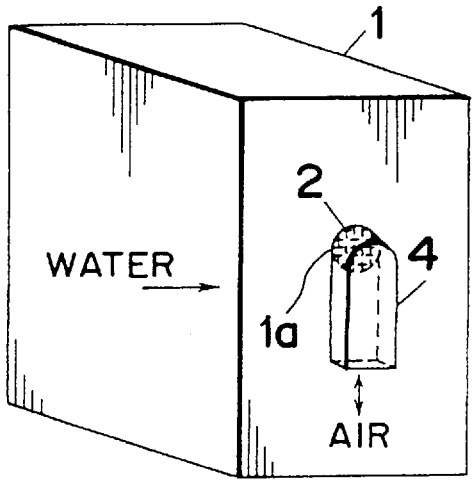
FIG. 2 is a view similar to FIG. 1, but indicating a modification thereof.

The ventilation duct 3 shown in FIG. 1 may be replaced by a box-like ventilation duct 4 shown in FIG. 2, which is directed downwardly so as to be diverted from the direction in which the casing 1 may be splashed with water.

It is to be noted here that although the filter 2 is mounted on the casing 1 so as to cover the vent hole 1*a*, it may be mounted inside the ventilation duct 3 or 4.

The ventilation duct 3 or 4 allows air to pass therethrough but prevents entry of water, which has been hitherto caused by thermal expansion and contraction of the air. Also, the ventilation duct 3 or 4 satisfactorily protects the filter 2.

Figure 3A:
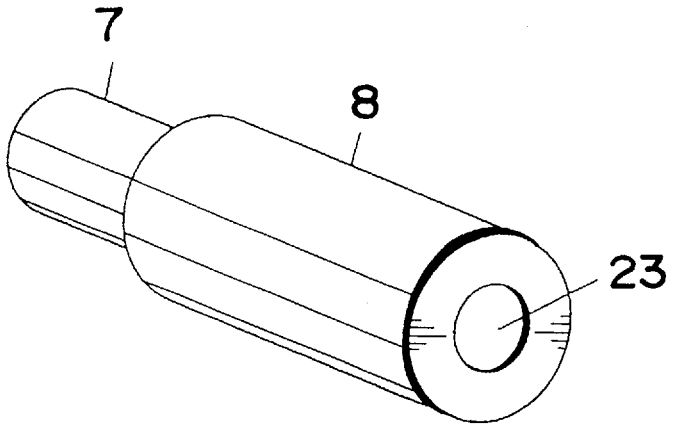
FIG. 3A is a perspective view of a ventilation arrangement according to a second embodiment of the present invention.
Figure 3B:
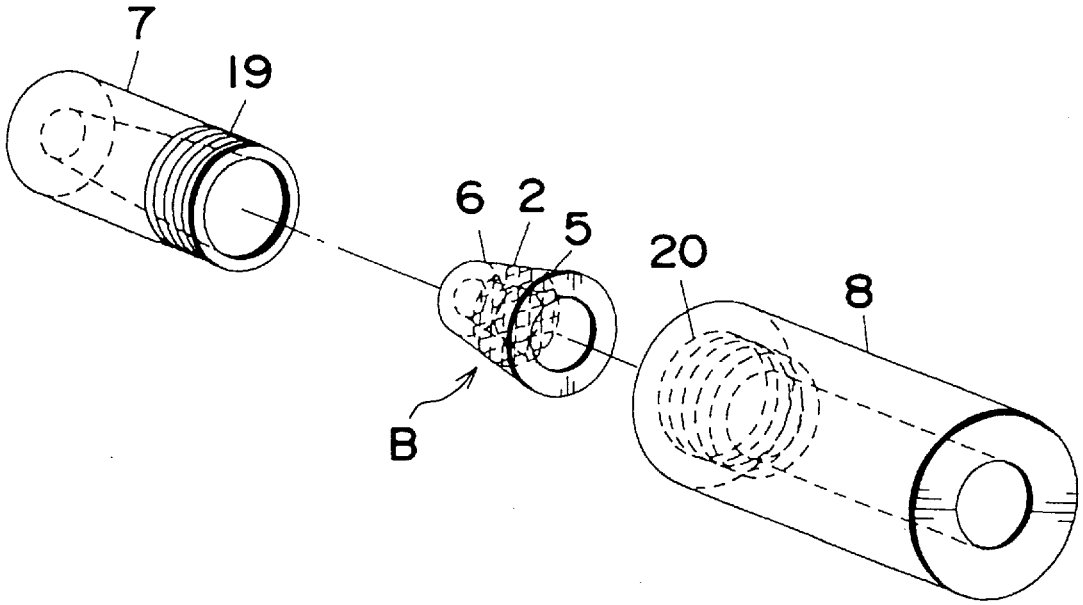
FIG. 3B is an exploded perspective view of the ventilation arrangement of FIG. 3A.

FIGS. 3A and 3B depict a ventilation arrangement according to a second embodiment of the present invention. The ventilation arrangement shown therein includes a first duct portion 7 having an externally threaded end 19, a second duct portion 8 having an internally threaded end 20, and a tapered filter block B placed in a through-hole 23 defined in the first and second duct portions 7 and 8.

As shown in FIG. 3B, the tapered filter block B is of an integrated structure including a filter 2, a first rubber frusto-conical member 5, and a second rubber frusto-conical member 6 with the filter 2 sandwiched between the first and second frusto-conical members 5 and 6. In assembling the ventilation arrangement, the tapered filter block B is first inserted into the externally threaded end 19 of the first duct portion 7 so that the first frusto-conical member 5 may slightly protrude from the externally threaded end 19 of the first duct portion 7. When the first duct portion 7 is threaded into the second duct portion 8, the protruding portion of the first frusto-conical member 5 is pressed down by the second duct portion 8. As a result, the filter 2 is positively held in the through-hole 23.

This arrangement facilitates filter maintenance and replacement. In replacing the filter 2, it is sufficient if the integrated filter block B is removed by rotating the second duct portion 8 relative to the first duct portion 7.

Figure 4:
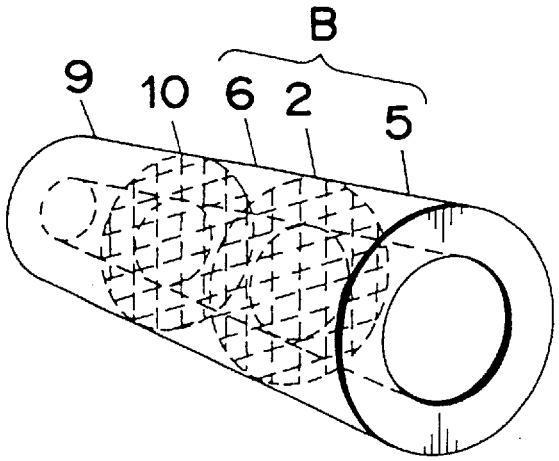
FIG. 4 is a perspective view of a ventilation arrangement according to a third embodiment of the present invention.

FIG. 4 depicts a ventilation arrangement according to a third embodiment of the present invention.

The ventilation arrangement of FIG. 4 comprises an integrated filter block B shown in FIG. 3B, a third rubber frusto-conical member 9 threaded into the filter block B, and a filter 10 sandwiched between the filter block B and the third frusto-conical member 9. The filter 2 remote from the casing 1 has a high permeability to catch, for example, dust, while the filter 10 close to the casing 1 has a low permeability to catch, for example, salt particles.

The use of the two filters 2 and 10 is resistant to clogging, compared with the use of only one filter, thus facilitating filter maintenance.

Figure 5A:
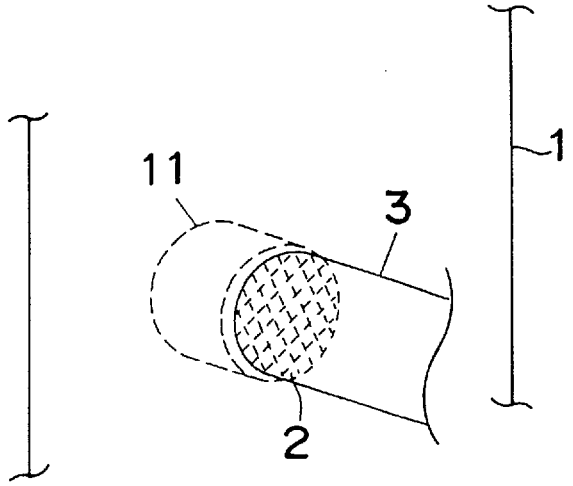
FIG. 5A is a perspective view of a ventilation arrangement according to a fourth embodiment of the present invention.
Figure 5B:
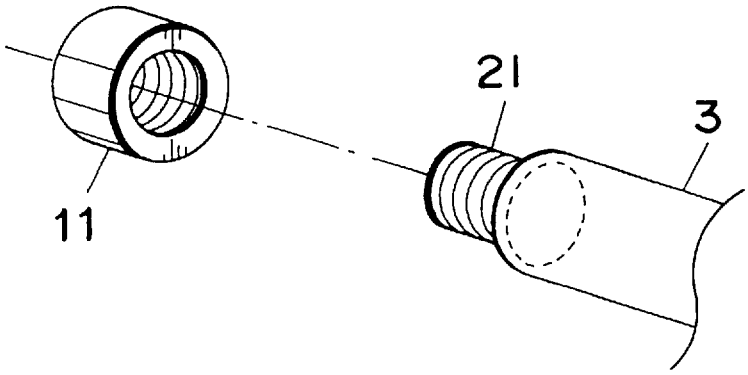
FIG. 5B is an exploded perspective view of the ventilation arrangement of FIG. 5A.

FIGS. 5A and 5B depict a ventilation arrangement according to a fourth embodiment of the present invention, which comprises a ventilation duct 3 having an externally threaded end 21 and extending outwardly from a casing 1 for a compressor drive unit, a filter 2 accommodated in the ventilation duct 3, and a nut 11 into which the ventilation duct 3 is threaded through the casing 1.

In replacing the filter 2 together with the ventilation duct 3, replacement can be readily carried out merely by rotating either the ventilation duct 3 or the nut 11. Furthermore, the ventilation duct 3 can be mounted on casings for a variety of compressor drive units if they have a vent hole defined therein. Accordingly, it is possible to make ventilation ducts (including associated filters) have an identical configuration for various casings.

Figure 6:
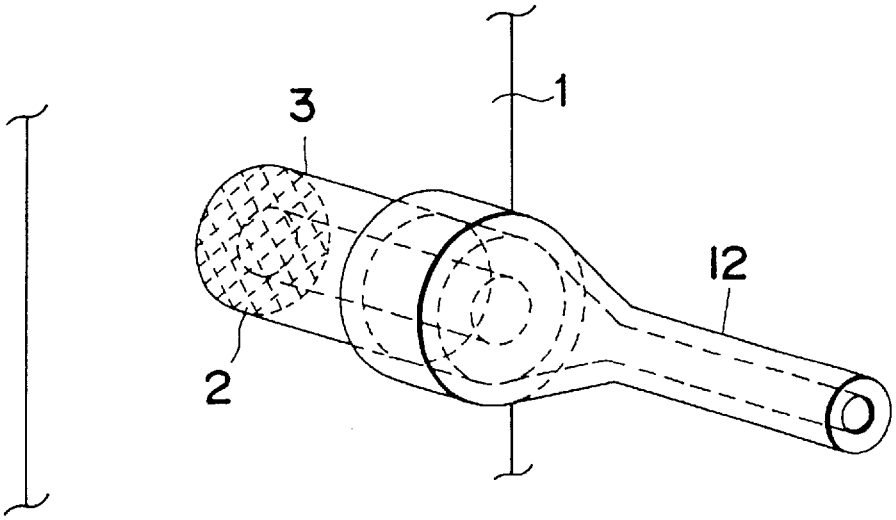
FIG. 6 is a perspective view of a ventilation arrangement according to a fifth embodiment of the present invention.

FIG. 6 depicts a ventilation arrangement according to a fifth embodiment of the present invention, which comprises a ventilation duct 3 extending outwardly from a casing 1, a filter 2 mounted on the casing 1 so as to cover a vent hole defined therein, and a hose duct 12 mounted on a free end of the ventilation duct 3.

The hose duct 12 is made of, for example, rubber and is therefore susceptible to bending. Because of this, even if the direction in which the ventilation duct 3 extends is fixed, it is possible to orient a free end of the hose duct 12 to a direction diverting from the direction in which the casing 1 may be splashed with water or may receive dust or the like.

A compressor drive unit having this ventilation arrangement on its casing can be applied to any kind of automotive vehicle and, also, can be mounted on a desired portion thereof if the free end of the hose duct 12 is appropriately oriented for each automotive vehicle.

Figure 7:
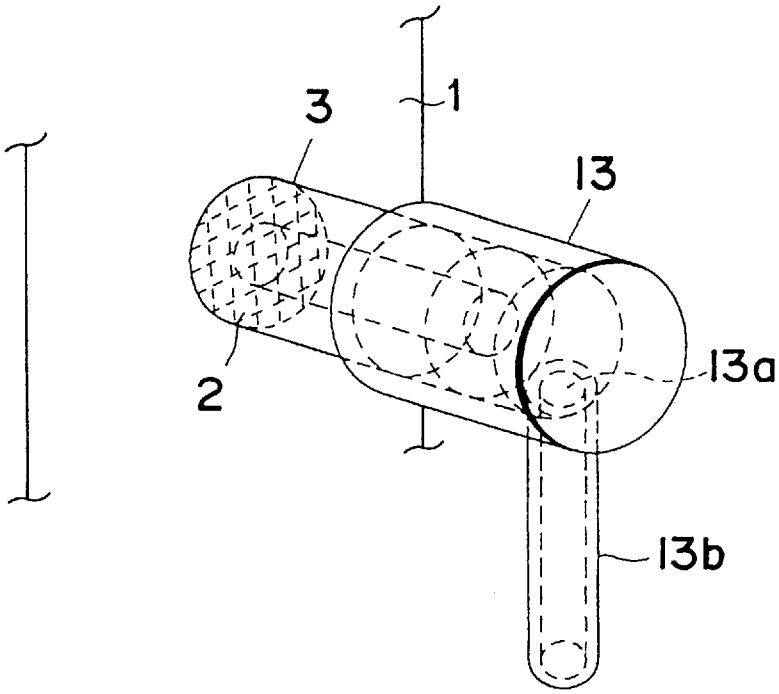
FIG. 7 is a perspective view of a ventilation arrangement according to a sixth embodiment of the present invention.

FIG. 7 depicts a ventilation arrangement according to a sixth embodiment of the present invention, which comprises a ventilation duct 3 extending outwardly from a casing 1, a filter 2 mounted on the casing 1 so as to cover a vent hole defined therein, and a hose duct 13 having a closed end and an open end rotatably mounted on a free end of the ventilation duct 3.

The hose duct 13 has a vent hole 13*a* defined therein and another duct 13*b* connected thereto so as to communicate with the vent hole 13*a*. The duct 13*b* has a diameter smaller than that of the hose duct 13. The duct 13*b* extends in a direction generally perpendicular to the direction in which the hose duct 13 extends so that a free end of the duct 13*b* may be oriented to any desired direction on a plane generally perpendicular to the hose duct 13 by rotating the hose duct 13 relative to the ventilation duct 3.

As is the case with the fifth embodiment referred to above, even if the direction in which the ventilation duct 3 extends is fixed, it is possible to orient the free end of the duct 13*b* to a direction diverting from the direction in which the casing 1 may be splashed with water or may receive dust or the like. A compressor drive unit having this ventilation arrangement on its casing can be applied to any kinds of automotive vehicles and, also, can be mounted on a desired portion thereof if the free end of the duct 13*b* is appropriately oriented for each automotive vehicle.

Figure 8:
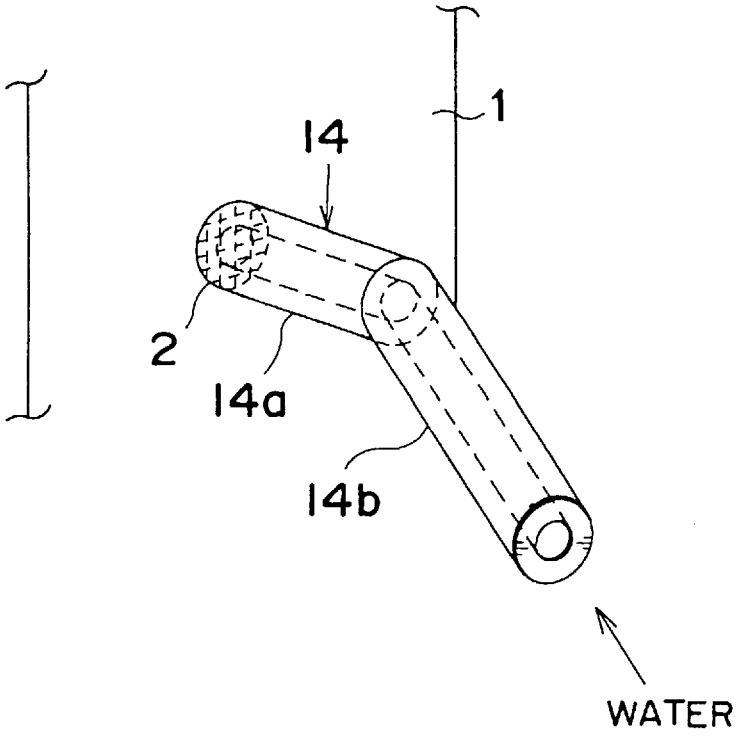
FIG. 8 is a perspective view of a ventilation arrangement according to a seventh embodiment of the present invention.

FIG. 8 depicts a ventilation arrangement according to a seventh embodiment of the present invention, which comprises a hose duct (or elongated ventilation duct) 14 having a first duct portion 14*a* extending outwardly from a casing 1 and a second duct portion 14*b* bent downwardly from the first duct portion 14*a*. A filter 2 is mounted on the casing 1 so as to cover a vent hole defined therein and is communicated with the first duct portion 14*a*.

With this ventilation arrangement, if water comes from a direction shown by an arrow and enters the second duct portion 14*b* of the hose duct 14, such water stops at the bent portion between the first and second duct portions 14*a* and 14*b* and does not reach the filter 2.

Figure 9A:
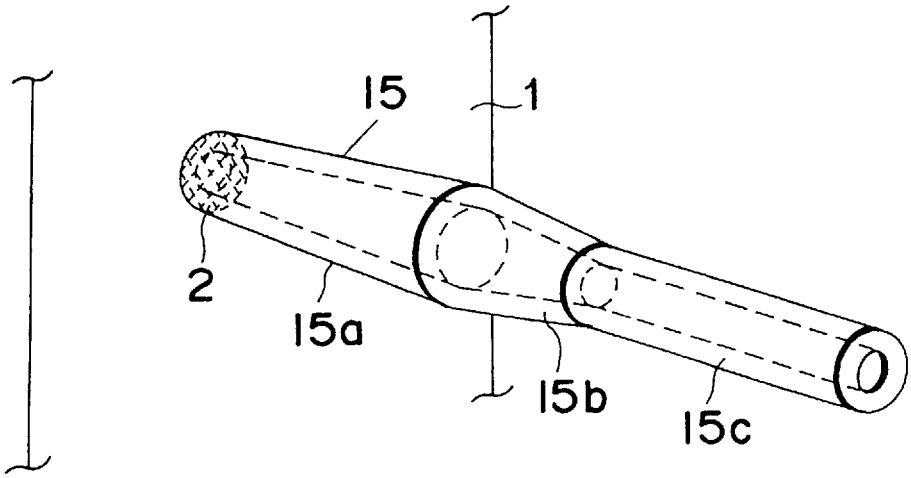
FIG. 9A is a perspective view of a ventilation arrangement according to an eighth embodiment of the present invention.
Figure 9B:
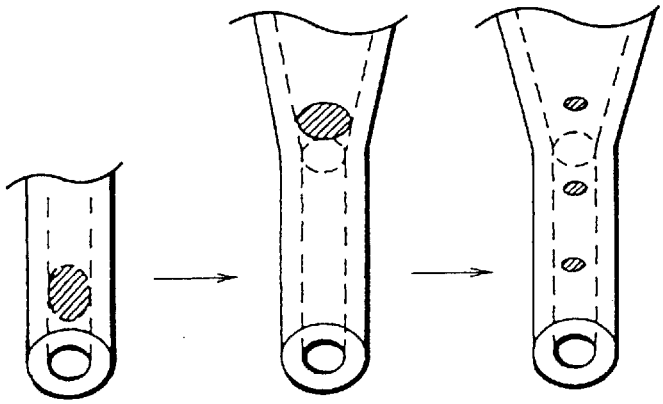
FIG. 9B is fragmentary perspective views of a hose duct mounted in the ventilation arrangement of FIG. 9A, particularly indicating the behavior of a drop of water sucked into the hose duct.

FIGS. 9A and 9B depict a ventilation arrangement according to an eighth embodiment of the present invention. This ventilation arrangement comprises a hose duct (or elongated ventilation duct) 15 made up of a first tapered portion 15*a* extending outwardly from the casing 1, a second tapered portion 15*b* joined to the first tapered portion 15*a*, and a straight tube portion 15*c* joined to the second tapered portion 15*b*. The first tapered portion 15*a* has varying inner and outer diameters which gradually increase towards the second tapered portion 15*b*, while the second tapered portion 15*b* has varying inner and outer diameters which gradually decrease towards the straight tube portion 15*c*. A filter 2 is mounted on the casing 1 so as to cover a vent hole defined therein and is communicated with the first tapered portion 15*a*.

With this ventilation arrangement, even if a drop of water enters the hose duct 15 through the straight tube portion 15*c*, when it reaches the second tapered portion 15*b* and approaches the first tapered portion 15*a*, as shown in FIG. 9B, its surface tension reaches a limit. As a result, the drop of water which has entered the hose duct 15 flows out therefrom as small drops of water. Even if the small drops of water are left within the hose duct 15, they no longer advance deep into the second tapered portion 15*b* in the presence of an air passage formed therebetween, thereby preventing entry of water into the casing 1. The same is true for the ventilation arrangement shown in FIG. 6.

Figure 10:
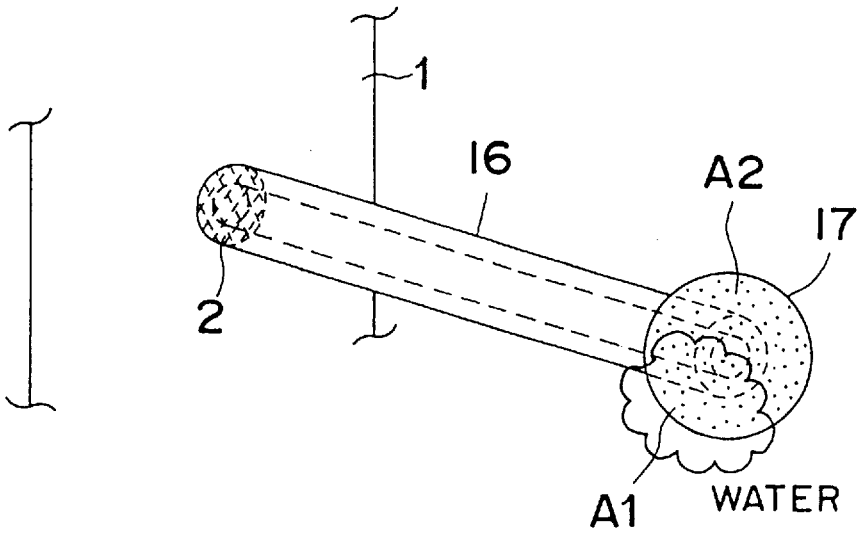
FIG. 10 is a perspective view of a ventilation arrangement according to a ninth embodiment of the present invention.
Figure 11:
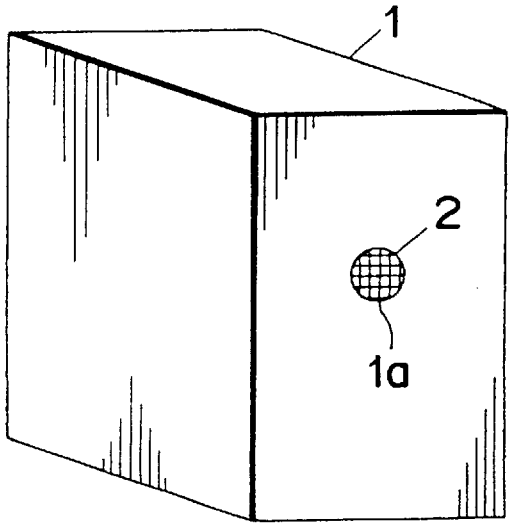
Fig. 11 PRIOR ART
FIG. 11 is a perspective view of a conventional ventilation arrangement (already referred to).

FIG. 10 depicts a ventilation arrangement according to a ninth embodiment of the present invention, which comprises a hose duct (or elongated ventilation duct) 16 extending outwardly from a casing 1 and a porous spherical member 17 secured to a free end of the hose duct 16. A filter 2 is mounted on the casing 1 so as to cover a vent hole defined therein.

With the ventilation arrangement of FIG. 10, if a portion A1 of the porous spherical member 17 is splashed with water, air is not allowed to pass through such a portion A1. However, because air can pass through the remaining portion A1 of the porous spherical member 17, water is not introduced into the casing 1 through the hose duct 16.

It is to be noted that although the porous spherical member 17 is employed in the ventilation arrangement of FIG. 10, a porous member having any desired configuration can also be employed.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A ventilation arrangement for a waterproof casing for covering an automotive compressor drive unit, said ventilation arrangement comprising:

a casing having a vent hole defined therein;

an elongated ventilation duct mounted on said casing so as to communicate with said vent hole, said elongated ventilation duct comprising a first duct and a second duct into which said first duct is threaded; and a filter block comprising a filter having an air permeability and a water repellency, and first and second frusto-conical members between which said filter is sandwiched;

wherein said filter block is mounted in said first duct so that, in a non-compressed state, said first frusto-conical member slightly protrudes from said first duct; and wherein said first duct is threaded into said second duct and a protruding portion of said first frusto-conical member is pressed down in a direction toward said first duct by said second duct.

2. The ventilation arrangement according to claim 1, wherein said filter block is tapered.

3. The ventilation arrangement according to claim 1, wherein said first and second frusto-conical members are made of rubber.

* * * * *